United States Patent [19]
Pinkston
[11] 4,318,194
[45] Mar. 9, 1982

[54] WATER CLOSET DIVERTER VALVE

[75] Inventor: David L. Pinkston, Allen Park, Mich.
[73] Assignee: Masco Corporation, Taylor, Mich.

[21] Appl. No.: 200,925
[22] Filed: Oct. 27, 1980
[51] Int. Cl.³ ..... E03D 1/36
[52] U.S. Cl. ..... 4/366; 4/367; 4/661; 137/410
[58] Field of Search ..... 4/366, 378, 367, 661; 137/410, 413

[56] References Cited

U.S. PATENT DOCUMENTS 3,086,217 4/1963 Barlow ..... 4/367
3,171,424 3/1965 Shames et al. ..... 137/410
3,172,128 3/1965 Ducey ..... 4/366 X
3,424,187 1/1969 Brennan et al. ..... 137/410 X
4,011,605 3/1977 Karlsson et al. ..... 4/366
4,230,145 10/1980 Badders ..... 137/410

*Primary Examiner*—Henry K. Artis
*Attorney, Agent, or Firm*—Whittemore, Hulbert & Belknap

[57] ABSTRACT

A water closet flushing system of a type employing a float-controlled valve through which water is supplied to refill the tank after the water in the tank has been dumped into the bowl to flush the bowl. A diverter valve is interposed in the line leading from the ballcock valve through which the tank is refilled and is operable to divert this flow of water under line press to outlets or nozzles disposed around the upper rim of the bowl as soon as the flushing process begins to provide a complete pressurized washing of the bowl. After the tank empties, the diverter valve automatically shifts to a position which directs the water to refill the tank.

7 Claims, 4 Drawing Figures

FIG. 1
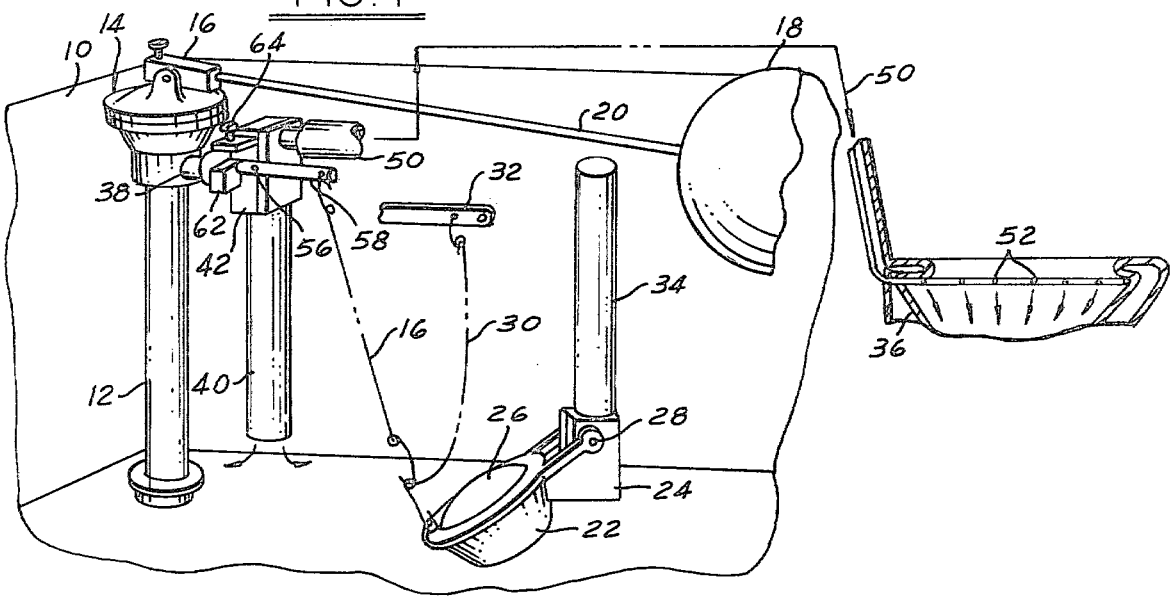
FIG. 2
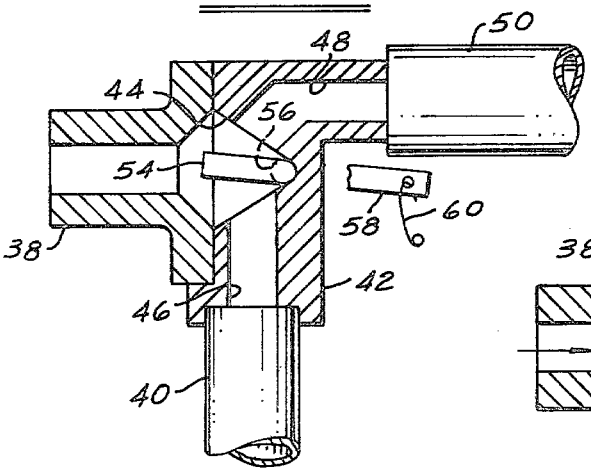
FIG. 3
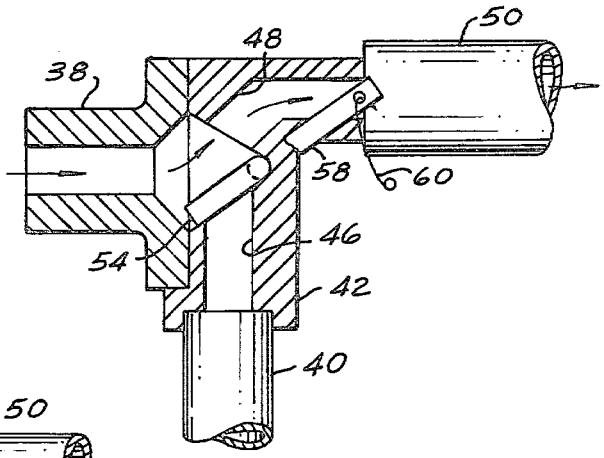
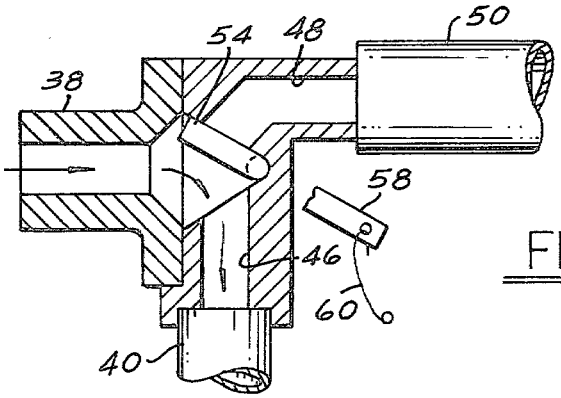
FIG. 4

WATER CLOSET DIVERTER VALVE

BACKGROUND OF THE INVENTION

Conventional gravity flushing systems generally supply a large amount of the water in the supply tank into the bowl outlet during the flushing operation with relatively small quantities of such water being supplied to outlets around the rim of the bowl. Such systems do not adequately or completely wash the bowl during the flushing operation. The present invention provides an automatically operable diverter valve which is designed to utilize a sufficient quantity of water under line pressure as soon as flushing is initiated to provide a complete pressurized bowl wash.

SUMMARY OF THE INVENTION

Conventional gravity flushing systems include a water supply tank having an outlet normally closed by a flapper valve which is opened by actuation of the flush lever to drain the contents of the tank into the toilet bowl for flushing the bowl. The flapper valve automatically closes under the influence of gravity when the tank is emptied and the tank is refilled through a supply pipe connected into the main water supply line through a ballcock valve under the control of a float so that when the water level is lowered the ballcock valve is opened to supply water to the refill pipe. According to the present invention a diverter valve is positioned in the discharge line leading from the ballcock valve to the tank refill pipe. The diverter valve carries an actuating arm biased in one direction by a weight carried by the actuating arm to close the upper end of the tank refill pipe thereby directing water under pressure to a line leading to the discharge outlets around the rim of the bowl. The diverter actuating arm is connected to the flapper valve through which water is discharged from the tank in such manner that when the flapper valve closes as the tank is emptied, the actuating arm and diverter valve are moved to a position which closes the line leading from the ballcock valve to the rim outlets and opens the upper end of the refill pipe so that the tank will be refilled through the ballcock valve.

BRIEF DESCRIPTION OF THE DRAWINGS

FIG. 1 is a fragmentary perspective view of a flushing apparatus according to the present invention.

FIG. 2 is an enlarged fragmentary sectional view showing the diverter valve in its normal position.

FIG. 3 is a view similar to FIG. 2 showing the diverter valve in the position it occupies immediately after the flushing operation is initiated.

FIG. 4 is a view similar to FIGS. 2 and 3 showing the diverter valve in the position it occupies toward the end of the flushing cycle.

DETAILED DESCRIPTION

In FIG. 1 there is disclosed a water supply tank 10 containing a supply pipe 12 having its lower end connected to the main water supply system and supporting a conventional ballcock valve 14 having an actuating arm 16 secured to a float 18 by a rod 20. Mounted on the bottom of the tank is a discharge outlet 22 having a fitting 24 to which a flapper valve 26 is pivoted by a pin 28. The valve 26 normally closes the discharge outlet 22 and has a chain or cable 30 secured thereto and extending to the actuating arm 32 of a conventional flush handle (not shown) mounted on the exterior of the tank.

The fitting 24 carries an overflow pipe 34 which functions in a conventional manner. When the flush handle is actuated the arm 32 will pivot upwardly and through the chain or cable 30 will lift the valve 26 to open the discharge fitting 22 to allow the water in the tank to be dumped into the toilet bowl 36 in a conventional manner. As the water level in the tank drops, the float 18 will be lowered thus actuating the ballcock valve 14 to its open position. In conventional gravity flushing system, the outlet 38 from the valve 14 is connected directly to the refill pipe 40 so as to refill the tank with water under pressure until the normal water level is reached whereupon the float 18 acts to close the valve 14.

The diverter valve of the present invention is shown in FIGS. 2, 3, and 4 and comprises a L-shaped fitting 42 having an inlet opening 44 communicating with the outlet pipe 38 leading from the ballcock valve 14. The fitting 42 includes a passage 46 in its lower end communicating with the upper end of the refill pipe 40 and a passage 48 leading to a supply line 50 which is adapted to supply water under pressure to a series of discharge outlets or nozzles 52 disposed around the rim of the bowl 36. The diverter valve includes a valve member 54 within the inlet opening 44 mounted on a pin 56 carried by the fitting 42 and extending outwardly thereof to support an actuating arm 58. Actuating arm 58 and the valve member 54 are secured to the pin 56 with the latter being rotatably mounted in the fitting 42 so that pivotal movement of the actuating arm 58 will cause the corresponding movement of the valve member 54.

A chain or cable 60 is secured to the end of the actuating arm 58 and is connected to an intermediate position of the cable 30 as shown in FIG. 1. A weight 62 is mounted on the other end of the actuating arm 58 and biases the arm 58 and the valve member 54 in a counterclockwise direction as viewed in the drawings.

The diverter valve normally occupies the position shown in FIG. 2 in which the valve member 54 occupies a more or less horizontal position with the passages 46 and 48 both communicating with the outlet passage from the valve 14. In this position the cable 60 is taut since the flapper valve 26 is closed and, through the cable 60, has pivoted the actuating arm 58 and valve member 54 to the position shown in FIG. 2. As soon as the flushing operation is initiated, the lever 32 is moved upwardly and through its cable 30 lifts the flapper valve 26 to open the discharge outlet 22 to allow the water in the tank to begin discharging into the bowl 36 in a conventional manner. As the cable 30 is pulled upwardly, the cable 60 will become slack and allow the weight 62 to pivot the actuating arm 58 and the valve member 54 to the position shown in FIG. 3 in which the valve member 54 closes the passage 46 leading to the refill pipe 40. The ballcock valve 14 is opened as soon as the water level in the tank drops due to the opening of the valve 26 and water under line pressure is therefore supplied through outlet pipe 38 to the passage 48 in fitting 42 and through line 50 to the discharge outlets 52 to provide a thorough pressurized washing of the rim of the bowl 36.

As the tank empties, the flapper valve 26 will close thereby exerting a pull on the cable 60 to pivot the actuating arm 58 and valve member 54 in a clockwise direction. The pivoting of the actuating arm in this direction causes the valve member to move slightly past the equilibrium position shown in FIG. 2 whereupon water under pressure will move the valve member 54 to the position shown in FIG. 4 in which it closes the passage 48 and directs the water into the refill pipe 40, which is open at its lower end so as to refill the tank until the water level rises to cause the valve 14 to be closed by the float 18. The weight 62 then will move the valve member 54 and its actuating arm 58 back to the equilibrium position shown in FIG. 2.

The diverter valve fitting 42 is provided with an adjustment screw 64, the lower end of which is adapted to engage the actuating arm 58 when such arm is pivoted in a clockwise direction so as to limit the extent to which the valve member 54 will close the passage 48. This allows some of the incoming water to flow through the line 50 to refill the bowl through the outlets 52 while the tank is being refilled through the pipe 40.

I claim:

1. In a water closet flushing apparatus including a supply tank, a water supply pipe connected to a source of water under pressure, a refill pipe and a float-controlled valve controlling the supply of water from said supply pipe to said refill pipe, a flush valve adapted to be manually opened to dump the water in said tank into the bowl for flushing the bowl, said bowl having a series of nozzles disposed around the rim of said bowl; the improvement comprising a diverter valve interposed in the connection between said float-controlled valve and said refill pipe, said diverter valve including a valve body having an inlet communicating with the outlet from said float-controlled valve, a first outlet communicating with said nozzles in said bowl and a second outlet leading to said refill pipe, a valve member in said valve body and movable therein between to close either of said outlets while opening the other and to an intermediate position in which both said outlets are open, means biasing said valve member toward a position closing said second outlet, and means connecting said diverter valve member and said flush valve whereby opening of said flush valve allows said biasing means to move said diverter valve member to close said second outlet, thereby opening said first outlet to discharge water under pressure from said supply pipe through said nozzles, and closing of said flush valve moves said diverter valve member against said biasing means toward a position closing said first outlet thereby opening said second outlet to refill said tank, said connecting means and said biasing means normally maintaining said diverter valve member in said intermediate position.

2. A diverter valve according to claim 1, wherein said valve members includes an actuating arm disposed exteriorly of said valve body and to which said biasing means and said connecting means are attached.

3. A diverter valve according to claim 2, wherein said actuating arm is pivotally mounted on said valve body, said biasing means and said connecting means being attached to said actuating arm on opposite sides of its pivot point.

4. A diverter valve according to claim 3, wherein said connecting means comprises a flexible member.

5. A diverter valve according to claim 1, wherein said valve member has a surface thereof presented toward said inlet as said valve member moves toward said position closing said first outlet whereby water from said supply pipes moves said valve member to said position.

6. A diverter valve according to claim 5, means engageable with said valve member to limit the extent to which said valve member closes said first outlet.

7. A diverter valve according to claim 6, wherein said means engaging said valve member is manually adjustable to regulate the flow through said first outlet to refill said bowl while said tank is being refilled.

* * * * *